United States Patent [19]

Luquette

[11] Patent Number: 4,878,663

[45] Date of Patent: Nov. 7, 1989

[54] DIRECT DRIVE REHABILITATION AND FITNESS APPARATUS AND METHOD OF CONSTRUCTION

[75] Inventor: Michael M. Luquette, Lafayette, La.

[73] Assignee: Innovative Therapeutic Designs, Inc., Oakland, N.J.

[21] Appl. No.: 268,783

[22] Filed: Nov. 8, 1988

[51] Int. Cl.[4] ..... 272 67; 272 117

[52] U.S. Cl. ..... 272/134; A63B/21/00

[58] Field of Search ..... 272/67, 94, 96, 116, 272/117, 118, 130, 131, 132, 133, 134, 136, 142; 128/25 R

[56] References Cited

U.S. PATENT DOCUMENTS

| | | | |
|---|---|---|---|
| 2,135,018 | 11/1938 | Svensson | 272/117 |
| 3,042,023 | 7/1962 | Yates | 128/25 R |
| 3,089,700 | 5/1963 | Hotas . | |
| 3,430,955 | 3/1969 | Mack . | |
| 3,563,542 | 2/1971 | Wellman | 272/67 X |
| 3,695,255 | 10/1972 | Rodgers et al. | 128/25 B |
| 3,905,599 | 9/1975 | Mazman | 272/118 |
| 4,258,913 | 3/1981 | Brenthan | 272/130 X |
| 4,349,194 | 9/1982 | Lambert, Jr. et al. | 272/118 |
| 4,494,751 | 1/1985 | Schnell | 272/117 |
| 4,515,363 | 5/1985 | Schleffendorf | 272/118 |
| 4,538,595 | 9/1985 | Hajianpour | 128/25 R |
| 4,577,623 | 3/1986 | Pecheux | 128/25 R |
| 4,591,149 | 5/1986 | Godfrey | 272/118 |
| 4,600,188 | 7/1986 | Bangerter et al. | 272/96 |
| 4,621,807 | 11/1986 | Stramer | 272/117 |
| 4,640,268 | 2/1987 | Roberts | 272/25 R |
| 4,641,832 | 2/1987 | Mattox | 272/67 |
| 4,733,859 | 3/1988 | Kock et al. | 272/96 |
| 4,757,992 | 7/1988 | Hetsch et al. | 272/134 |

*Primary Examiner*—Richard J. Apley
*Assistant Examiner*—Robert W. Bahr
*Attorney, Agent, or Firm*—Fulwider, Patton, Lee & Utecht

[57] ABSTRACT

A direct drive rehabilitation and fitness apparatus and method having a range limiter disk cooperating with an inclined cam surface, the method of construction requiring the range limiter disk to be directly coupled to the inclined cam surface through a drive shaft for converting rotational motion of the limiter disk into translational motion of the drive shaft for providing vertical movement of a weight stack. The method of construction provides that the range limiter disk be fitted with an adjustment pin for limiting the range of motion of an actuator arm and that a shaft supporting the weight stack communicate with a cam follower for riding along the translating inclined cam surface. The apparatus and method permit opposing patterns of movement with the range limiter disk by repositioning the adjustment pin thus making possible concentric and eccentric movements of opposing muscle groups. A first alternative embodiment is disclosed which eliminates the inclined cam surface while two additional alternative embodiments incorporate similar method and structure for therapeutic rehabilitation.

29 Claims, 5 Drawing Sheets

FIG. 2
PRIOR ART
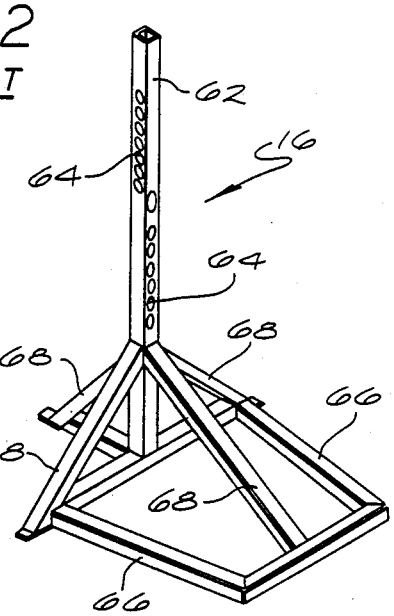
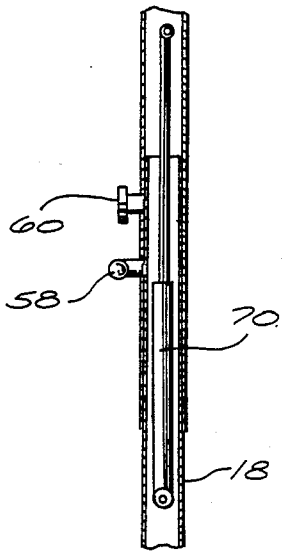
FIG. 3
PRIOR ART
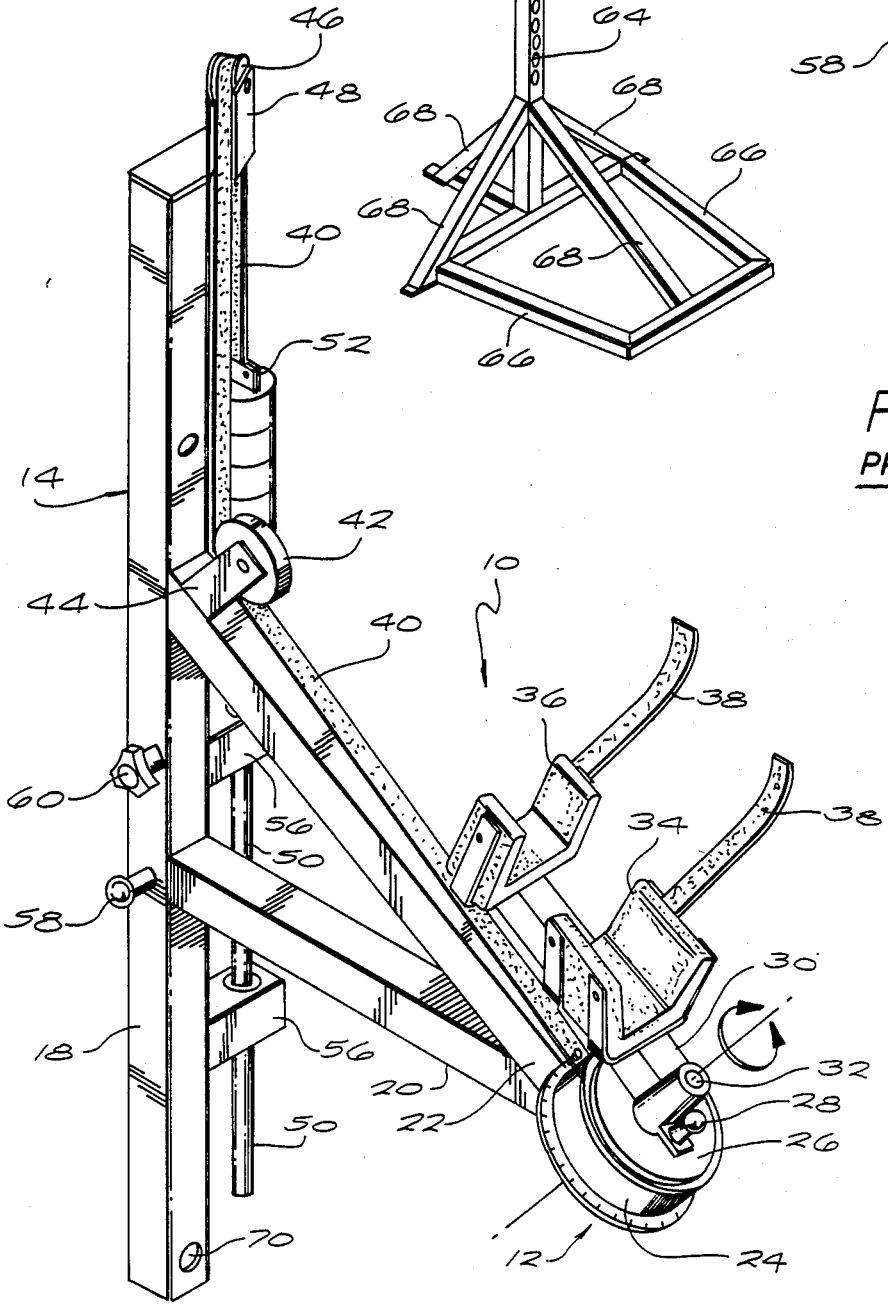
FIG. 1 PRIOR ART FIG. 7
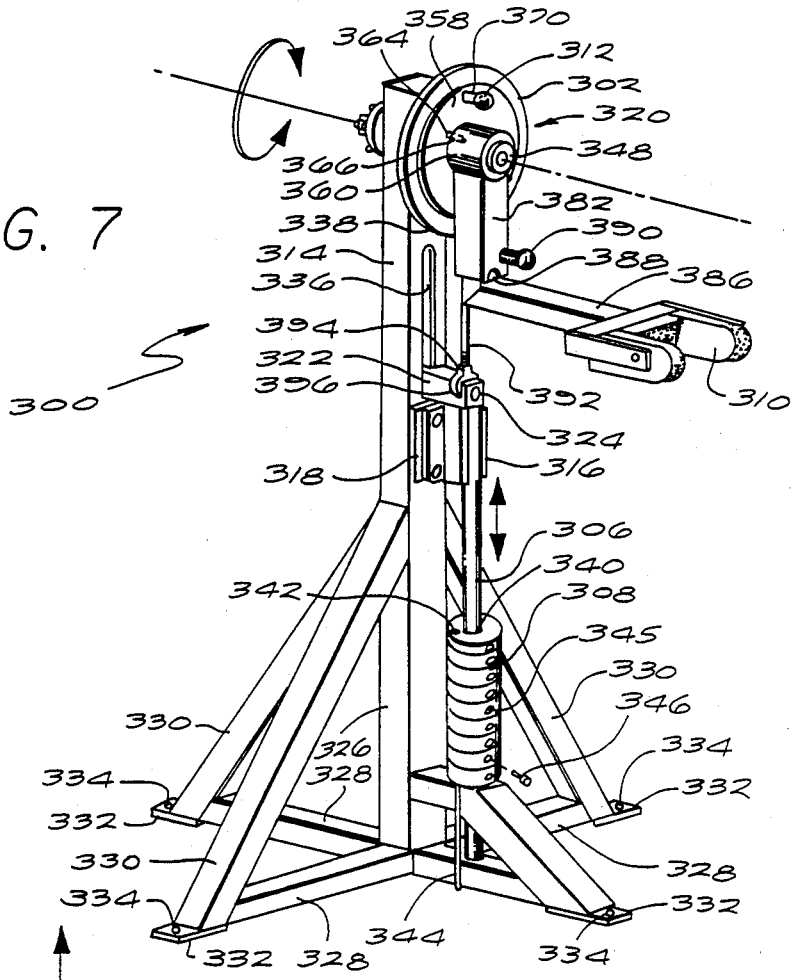
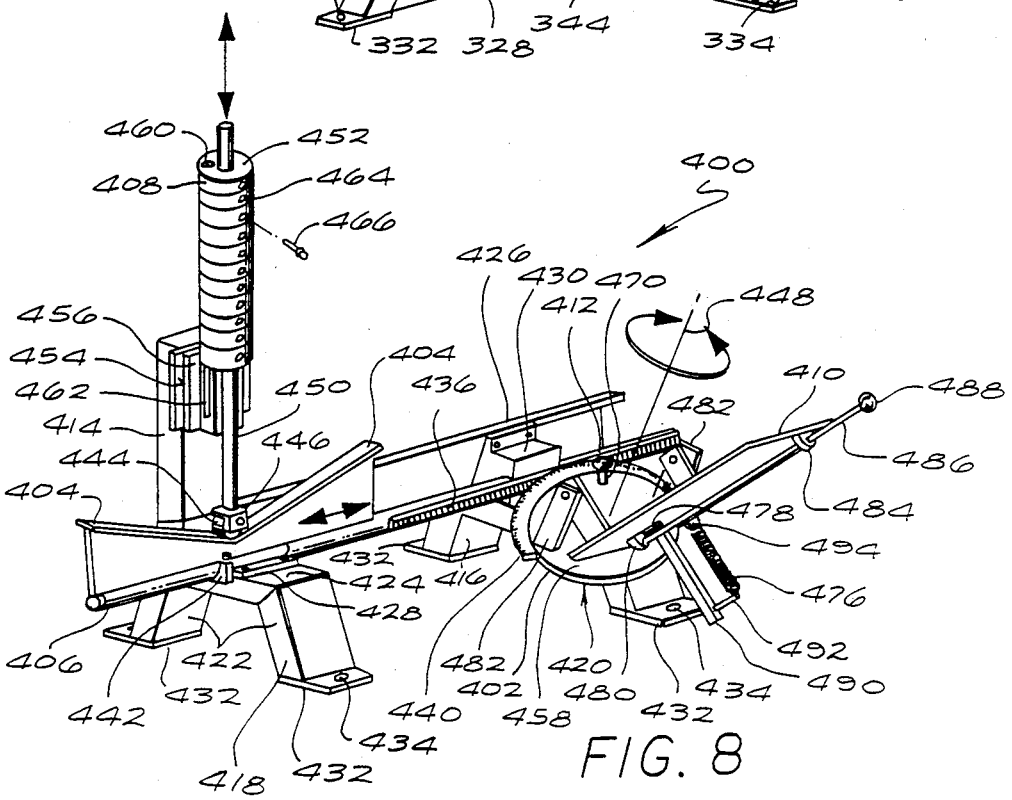
FIG. 8

DIRECT DRIVE REHABILITATION AND FITNESS APPARATUS AND METHOD OF CONSTRUCTION

BACKGROUND OF THE INVENTION

This invention relates generally to rehabilitation and exercise equipment, and more particularly, to a new and improved direct drive rehabilitation and fitness apparatus and method of construction which converts rotational to reciprocating motion for exercise therapy.

In the field of rehabilitation and exercise equipment, various types of machines are known, many of which employ a pulley-belt system connected to a weight stack or other resistance. The machine may be designed for use while the operator is in a seated or standing position. Other rehabilitation systems have included pulley-cable or chain-sprocket designs for connecting the weight stack to a main frame within the actuating mechanism. More advanced machine designs have included hydraulic, pneumatic and electrical resistance schemes.

An important consideration in the rehabilitation of injured joints and limbs is the movement path of the limb during therapeutic exercise. By definition, an eccentric movement of the arm is the extension of the arm along the axes of the elbow away from the shoulder resulting in the extension or stretching of the biceps muscle. Further, a concentric movement incorporates the contraction of the arm at the elbow to a collapsed position resulting in a contraction or flexing of the biceps muscle. These two movements are extremely important in the rehabilitation of the shoulder joint and are commonly prescribed for patients in physical therapy.

An example of a rehabilitation and exercise device known in the past included a drive apparatus mounted on a support structure. The support structure included a three dimensional broad base for providing stability to a vertical member which was mounted and diagnonally supported at the center of the base. The vertical member was comprised of a rectangular structure having a plurality of penetrations therethrough for receiving an adjustment pin.

The drive apparatus included a main frame for providing structural support which was also rectangular in shape and which was fashioned for fitting over the vertical member of the lattice shaped bottom support structure. Connected to the main frame in an orthogonal manner was a cross member which was employed for supporting the drive apparatus.

The drive apparatus was comprised of a rotary mechanism having a center axis. Connected to the center axis was an actuator bar which included a forearm cuff and a wrist cuff with corresponding securing straps for aligning a body limb with the axis of rotation of the drive apparatus. The apparatus permitted the limb of the operator to be aligned with the axis of rotation during the operation of the rotary mechanism. Also included was a pull pin which acted as a range limiter employed for adjusting the range of motion of the drive apparatus.

Connected to a forward part of the drive apparatus was a webbed belt which extended along a diagonal support member connected between the main frame and the cross member. At the interface between the diagonal support and the main frame, a first pulley was mounted for receiving and circuiting the webbed belt to and over a second pulley mounted at the top of the main frame. The belt was circuited over the second pulley and extended downward for connecting to an attachment piece for securing the belt to a weight stack support and guide.

The weight stack support and guide was employed for securing a stack of weights on the rehabilitation exercise device. The guide included a shaft passing through the weight stack and connecting to the attachment piece. Further, guidance was provided by passing the guide shaft through a plurality of alignment blocks for securing the guide shaft and the weight stack. It should be noted that although a webbed belt was employed in the instant rehabilitation device, a chain or cable could be employed utilizing the existing pulley or a toothed sprocket for mating with the chain.

Located along the main frame was a frame adjustment pin utilized for adjusting the height of the drive apparatus along the vertical member of the support structure. This adjustment permitted the machine to accomodate persons of different height so that the limb could be aligned with the axis of rotation of the drive apparatus. Also included was a cornerlock which was employed for stabilizing the rehabilitation device and for preventing the top portion of the drive apparatus from moving on or about the bottom support structure.

Further, a pressurized gas or hydraulic cylinder was located within the main frame and was employed when the top portion was released or disassembled from the bottom support structure. During such release or disassembly, the cornerlock was loosened and the adjustment pin was removed from one of the plurality of penetrations in the vertical member of the support structure. Although the attachment pin was employed for adjusting the height of the device, the cornerlock was utilized only for stabilizing the device during adjustment or for the total disassembly of the device.

A major problem associated with rehabilitation devices known in the past is that an operator can not use the same machine to perform both eccentric and concentric movement patterns. Thus, the devices in the past have not provided the convenience and capability of permitting an extension movement of the arm followed by a contraction movement of the arm, each along the axis of the elbow on the same machine. Further problems include the high maintenance factor associated with pulleys and chain or belt driven exercise devices. The frictional wear factor causes the structure elements to wear rapidly. Environmental conditions, particularly humidity will result in the belts stretching or contracting, each of which produce mechanical play in the operating mechanism.

Noise is an additional factor with this type of mechanical driven apparatus. A suitable engineering solution to minimize noise either results in increased design costs or increased maintenance costs. Friction also results in reduced efficiency and quality of the operation of the machine. A personnel hazard is also present when belts, chains, cables and pulleys are employed. Therefore, safety guards are required in these devices which also increases manufacturing costs.

Several attempts to solve these problems have resulted in evolution of rehabilitation devices. Initially, cable-pulley systems were common, however, cables were eventually replaced by chain-sprocket mechanisms which did not stretch. Eventually, the chain-sprocket mechanism was replaced by the webbed belt which generally improved the efficiency of the device. It is well known that rubber webbed belts generally last longer since cables and chains tend to wear because of friction produced by the mechanical engagement. In particular, the chain tended to wear because the pitch diameter of the chain resulted in wear to the sprockets. Further, failure to lubricate the sprocket resulted in additional wear. In addition, the required safety guards were a factor in eliminating chain driven devices. The webbed belt may be comprised of a fiber glass material in combination with a nylon webbing, the combination being a substantial improvement. However, the cost factor has been high since such a combination of materials is manufactured by and only available through limited sources.

Additional attempts to solve the aforementioned problems included hydraulic and pneumatic systems which provided a predetermined calibrated resistance to the movement of the drive apparatus by the operator. Another example included an electronic resistance element. This application included an electrical motor that provided a resistance when a mechanical load was applied to the motor shaft. The major problem associated with this application was inaccuracy due to the inability to calibrate the motor resistance properly. Although the electronic resistance device appeared to have potential, as with several rehabilitation devices of the past, it was cost prohibited.

Hence, those concerned with the development and use of rehabilitation and fitness equipment in the medical and physical therapy fields have long recognized the need for an improved rehabilitation apparatus which permits operation through opposing patterns of movement of opposing muscle groups on the same machine and which has a direct drive design that can be retrofitted to existing rehabilitation devices. Further, the apparatus can be manufactured and marketed at a substantial savings over other similar machines of the past and will eliminate cables, chains, belts, pulleys and safety guards associated therewith. Further, mechanical play in the mechanism is virtually eliminated minimizing frictional wear of components and reducing personnel safety hazards. The present invention fulfills all of these needs.

SUMMARY OF THE INVENTION

Briefly, and in general terms, the present invention provides a new and improved rehabilitation and fitness apparatus construction which substantially improves the utility of the apparatus by permitting opposing patterns of movement of opposing muscle groups on the same machine, and which significantly simplifies the design over similar types of prior art devices. Moreover, the rehabilitation and fitness apparatus construction of the present invention is less expensive to manufacture, can be retrofitted to existing rehabilitation and fitness devices, essentially eliminates mechanical play in the operating mechanism for minimizing frictional wear, and attains the improved result without need for cables, chains, belts, pulleys, safety guards or the like.

Basically, the present invention is directed to an improved rehabilitation and fitness apparatus and method of construction for increasing the utility of the apparatus by permitting opposing patterns of movement of opposing muscle groups to be performed on the same machine. This is accomplished by modifying the design of the upper structural elements by providing a range limiter disk connected to an inclined cam surface through a direct drive linkage.

In accordance with the invention, as a torqu is applied to the range limiter disk, rotational motion is converted into translational motion of a direct drive shaft and the inclined cam surface resulting in the vertical movement of a weight stack up the inclined cam surface.

In accordance with the improved method of the present invention, as the range limiter disk is rotated in a first direction for providing a concentric movement to a first muscle group, the drive shaft causes the inclined cam surface to translate towards the operator forcing a support shaft to ride up the cam surface raising the weight stack. As the limiter disk is permitted to gradually return to the original position, resistance is applied for opposing the travel of the weight stack down the cam surface for providing an eccentric movement to the first muscle group. By readjusting a range limiter pin on the limiter disk, eccentric and concentric movements may be performed on a second opposing muscle group on the same machine.

The new and improved rehabilitation and fitness apparatus and method of construction of the present invention improves the utility of the apparatus by permitting opposing patterns of movement of opposing muscle groups on the same machine, and simplifies the design by incorporating a direct drive linkage in conjunction with a translating inclined cam surface. Moreover, the improved method of construction is less expensive to manufacture, can be retrofitted to existing rehabilitation and fitness devices, essentially eliminates mechanical play in the operating mechanism for reducing frictional wear, and attains the improved result without the need for cables, chains, belts, pulleys, or safety guards.

These and other features and advantages of the invention will become apparent from the following more detailed description, when taken in conjunction with the accompanying drawings, which illustrate, by way of example, the features of the invention.

BRIEF DESCRIPTION OF THE DRAWINGS

FIG. 1 is a perspective view of the top portion of a shoulder rehabilitation apparatus of the prior art;

FIG. 2 is a perspective view of a bottom support structure of the shoulder rehabilitation apparatus of FIG. 1;

FIG. 3 is a frontal elevational view of a pressurized gas cylinder of the shoulder rehabilitation apparatus of FIG. 1;

FIG. 7 is a perspective view of a first alternative embodiment of a direct drive rehabilitation and fitness apparatus of the present invention;

FIG. 8 is a perspective view of a second alternative embodiment of a direct drive rehabilitation and fitness apparatus of the present invention.

DETAILED DESCRIPTION OF THE INVENTION

Figure 4:
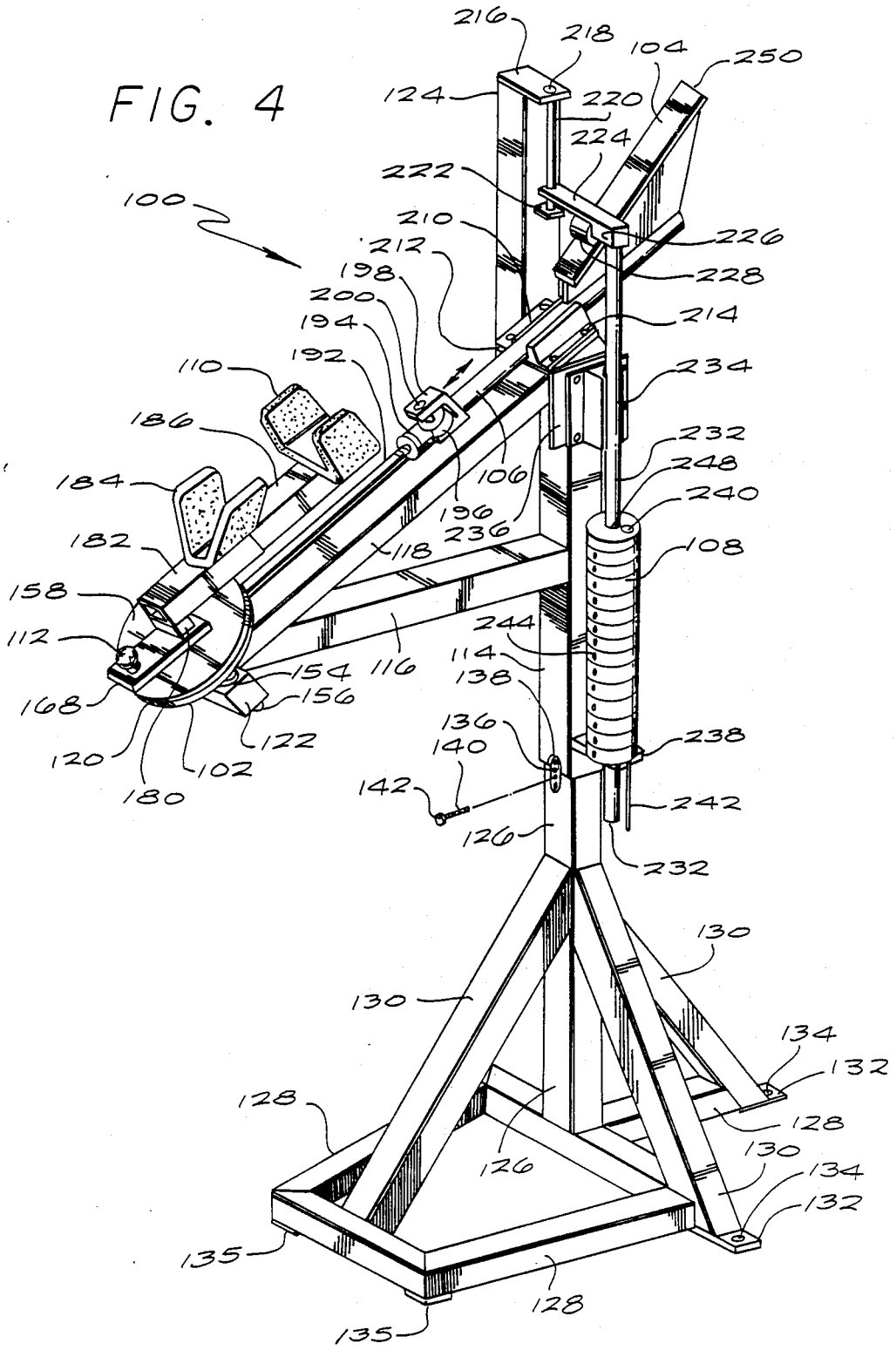
FIG. 4 is a perspective view of the direct drive rehabilitation and fitness apparatus of the present invention.

As shown in the drawings for purposes of illustration, the invention is embodied in a rehabilitation and fitness apparatus 100 of the type having a range limter disk 102 connected to an inclined cam surface 104 through a direct drive shaft 106 for converting rotational motion of the disk 102 into translational motion of the drive shaft 106 for providing vertical movement of a weight stack 108 along the inclined cam surface 104.

Rehabilitation and exercise devices of the past generally were comprised of a system of cables or belts in conjunction with a plurality of pulleys, or of chains and toothed sprockets for translating movement from the operator to a weight stack or other resistance mechanism. Such designs of the past could be used in the seated or standing position depending upon the muscle group to be exercised. Such a rehabilitation device 10 included a drive apparatus 12 utilized for permitting an operator to align the body limb to be exercised with the axis of rotation of the drive apparatus for permitting movement as is shown in FIG. 1.

The rehabilitation device 10 included a top main frame 14 and a bottom support structure 16. The top main frame was comprised of a vertical member 18 and a crossbeam member 20 which extends from the vertical member in an orthogonal direction. Also connected to the vertical member and intersecting the crossbeam member 20 at a specified distance from the vertical member was a diagonal support member 22.

At the intersection of the crossbeam member 20 and the diagonal support member 22 was a rotary mechanism 24 which included a range limiter device 26 having a pull pin adjustment knob 28 for limiting the rotational displacement of an actuator bar 30. The actuator bar rotated about a center axis 32 of the range limiter device 26. By manipulating the pull pin adjustment knob, the range of the actuator bar 30 could be modified for controlling the angular sector that the actuator bar could be rotated through. By limiting the range through which the actuator bar could operate, specific groups of muscles could be exercised for rehabilitation and fitness.

The actuator bar 30 carried a forearm cuff 34 and a wrist cuff 36 for positioning a limb of the operator therein. Each of the cuffs included an adhesive securing strap 38 for securing the limb during the exercise.

Connected to the base of the rotary mechanism 24 was a webbed belt or cable 40, which was circuited to run the extent of the diagonal support 22. Mounted on the top side of the diagonal support member, and adjacent to the vertical member 18 was a first pulley 42 secured by a bracket 44. The first pulley was employed for redirecting the webbed belt 40 in a vertical direction to a second pulley 46 secured to the vertical member 18 by a second bracket 48. The webbed belt passed over the second pulley and was connected to a weight stack support guide 50 by an attachment piece 52. The weight stack support guide 50 was employed for aligning and supporting an adjustable weight stack 54 which rode up and down the support guide as the actuator bar 30 was operated.

The webbed belt 40 was employed for connecting the drive apparatus 12 to the adjustable weight stack 54 which served as a resistance. The support guide 50 passed through a plurality of alignment blocks 56 which served to align the support guide and provide stability to the adjustable weight stack 54.

The top main frame 14 further included a frame adjustment pin 58 and a cornerlock knob 60. The frame adjustment pin 58 was employed for adjusting the height of the top main frame on the bottom support structure 16 for aligning the operators limb with the axis of rotation of the machine. Likewise, the cornerlock knob 60 was employed for securing and stabilizing the machine by preventing the top main frame from moving about the bottom support structure. Additionally, the cornerlock knob and the frame adjustment pin would both be employed for disassembling the rehabilitation device 10.

The bottom support structure 16 included a vertical support 62 having a plurality of penetrations 64. The vertical support 62 was mounted on a broad base 66 which was employed for providing a three dimensional planar support. A plurality of angular supports 68 connected the extreme ends of the broad base 66 to the vertical support 62 for distributing the mechanical load about the broad base. During adjustment of the height of the top main frame 14 above the bottom support structure 16, one of the plurality of penetrations 64 located along the vertical support 62 was aligned with the frame adjustment pin 58 for securing the device 10 at the selected height. Once the frame adjustment pin 58 was positioned and the cornerlock knob 60 was secured, the broad base 66 supported the device 10.

Within the vertical member 18 of the top main frame 14, there was a pressurized gas cylinder or hydraulic cylinder 70 as shown in FIG. 3. The pressurized gas cylinder 70 was employed when the top main frame 14 was released or disassembled from the bottom structural support 16. During either of these procedures, the cornerlock knob 60 was loosened while the frame adjustment pin 58 was released. Under these conditions, the pressurized gas cylinder permitted the top frame member 14 including the adjustable weight stack 54 to be gradually lowered onto the bottom support structure for adjustment or disassembly.

Many problems existed with the type of structure illustrated in FIGS. 1-3, some of which included high maintenance costs caused by friction associated with the pulleys, cables, chains, and belts. Further, the combination of independent components included a substantial degree of mechanical play resulting from frictional wear and the contraction and expansion of the webbed belt 40. The mechanical play also resulted in substantial noise which was difficult to eliminate. Further, the inclusion of belts or cables, pulleys, and chains and sprockets always presented the possibility of personnel injury and necessitated the use of a guard, which increased the cost of production. Most significantly, the rehabilitation devices employed in the past did not permit employing the same machine for performing both eccentric and concentric movement patterns on opposing set of muscle groups.

Various improvements of the prior art rehabilitation devices resulted in the chain and sprocket design replacing the cable-pulley design, with the webbed belt 40 in combination with the first and second pulleys 40, 42 replacing the chain and sprocket. The pitch diameter of the chain and the failure to lubricate regularly resulted in substantial wear to the sprocket. Other attempts employing hydraulic and pneumatic resistance means were attempted while the application of an electrical motor employed as the variable resistance was not accurate, was difficult to calibrate, and resulted in prohibitive manufacturing costs.

In accordance with the present invention, an adjustable wrist cuff 110 and the range limiter disk 102 cooperate with the inclined cam surface 104 for improving the utility of the apparatus 100 by permitting opposing patterns of movement of opposing muscle groups with the range limiter disk by adjusting a range limiter pin 112 extending through the limiter disk, and to significantly simplify the design by connecting the range limiter disk to the inclined cam surface through the direct drive shaft 106. Furthermore, the apparatus is relatively inexpensive to manufacture, can be retrofitted to existing rehabilitation and fitness devices, essentially eliminates mechanical play in the operating mechanism thus minimizing frictional wear, and does not require pulleys, safety guards, belts, chains, cables or the like to obtain the improved results.

The rehabilitation and fitness apparatus 100 includes an upper support column 114 for providing vertical support to the apparatus. Connected to and extending orthogonally away from the upper support column is a cross support beam 116 which provides support to a drive mechanism support beam 118. The drive mechanism support beam extends from the top of the upper support column 114 and is jointed to the cross support beam 116 for supporting a range limiter and drive device 120 as is illustrated in FIG. 4. The range limiter and drive device is mounted on a block 122 at the end of the drive mechanism support beam 118. Located at the top of the interface of the upper support column and the drive mechanism support beam is a dogleg support column 124 which is utlized for guiding and supporting a weight resistance means such as the weight stack 108.

Mounted within the bottom edge of the upper support column 114 in a telescopic manner is a lower support column 126. The lower support column extends downward to a base 128 comprised of a lattice structure for forming a plane for mounting on the floor. Also included is a plurality of diagonal supports 130 which extend between the lower support column 126 and the base, the combination of the lower support column, the base and the diagonal supports providing a secure mounting structure for the rehabilitation and fitness apparatus 100. Additionally, at the interface of each of the diagonal supports 130 with the base 128, there exists a mounting plate 132 having a penetration 134 formed therein for fastening the lower support column 126 to the floor. Further, there is included a pair of balancing pads 135 which are employed for leveling the base on the floor.

Figure 6:
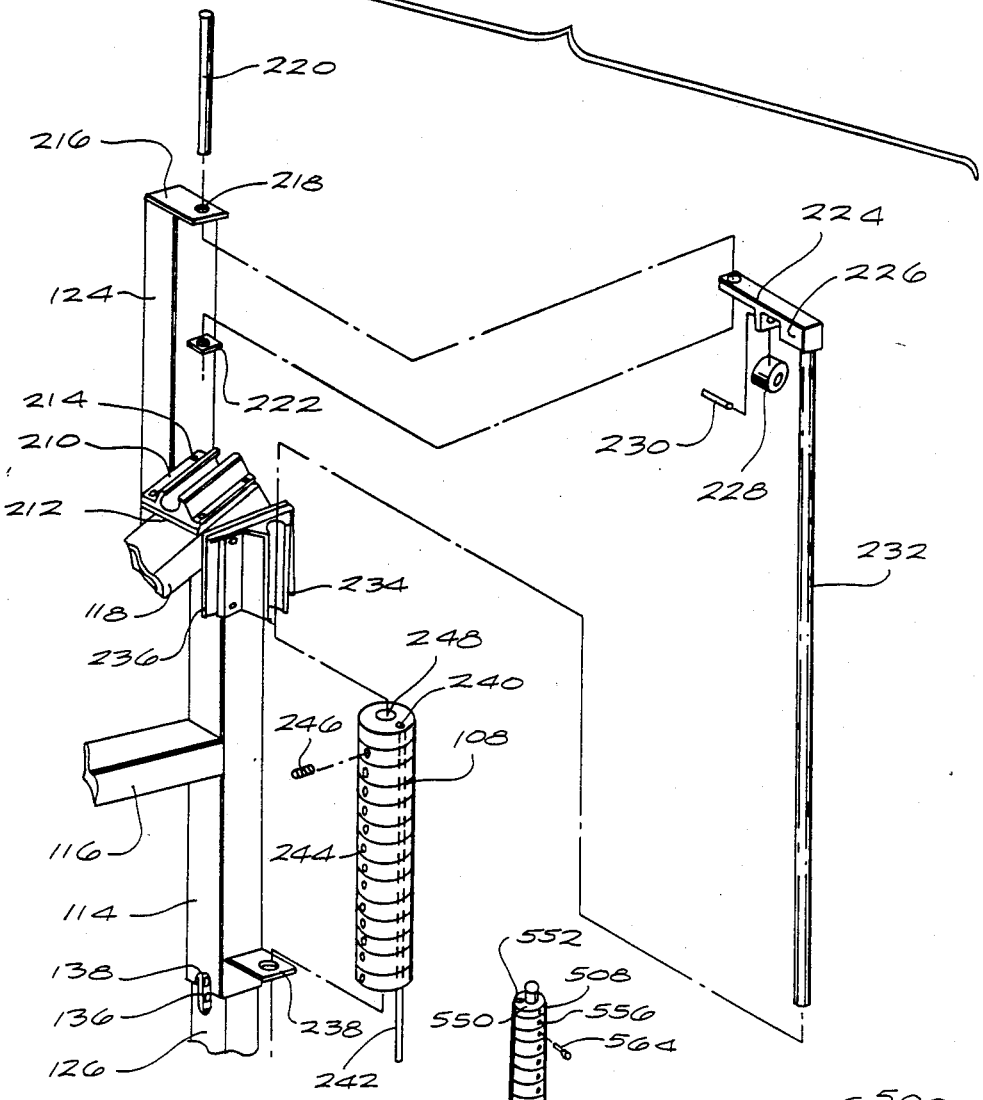
FIG. 6 is an exploded detail view of the weight resistance device of the rehabilitation and fitness apparatus of FIG. 4.

The lower support column 126 further includes a plurality of apertures 136 utilized for adjusting the height of the upper support column 114 above the base 128 along the lower support column as is illustrated in Figs. 4 and 6. Likewise, the bottom of the upper support column 114 includes a semicircular or hemispheric indentation 138 for accommodating an adjustment stud 140 for positioning within the adjustment apertures 136. It should be noted that adjustment stud 140 may be a cylindrically shaped pin comprised of a suitable high grade steel which may be physically inserted into and removed from the adjustment apertures 136. However, the adjustment stud may also be a threaded shaft having a knob 142 attached to the end thereof in the form of a cornerlock knob for threadedly engaging with the plurality of adjustment apertures 136 having complimentary threads formed therein.

Figure 5:
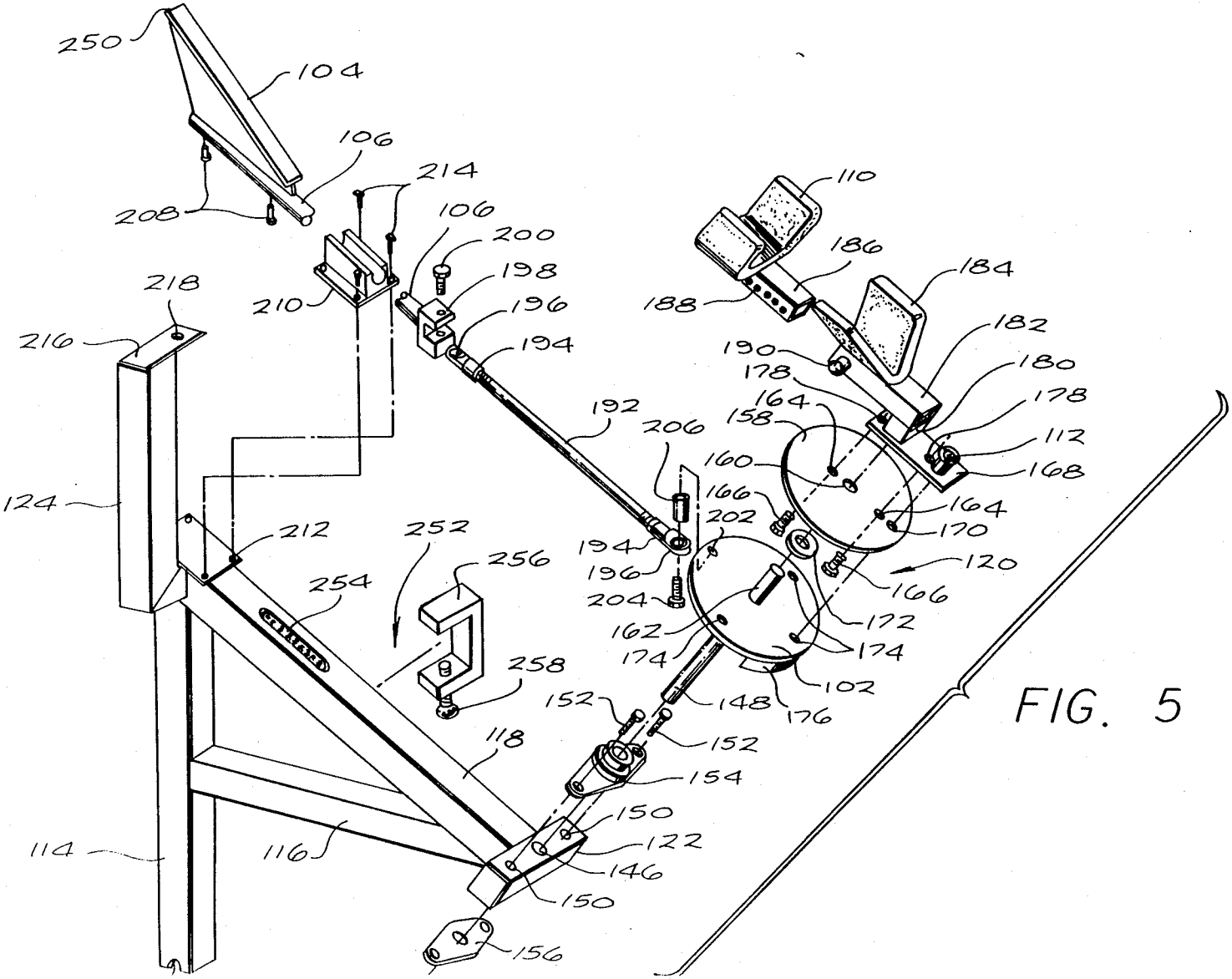
FIG. 5 is an exploded view of the rehabilitation and fitness apparatus of FIG. 4.

The block 122 located at the end of the drive mechanism support beam 118 includes a circular passageway 146 for accommodating a limiter shaft axis of rotation 148 which passes through the range limiter and drive device as shown in the exploded view of FIG. 5. The block 122 also includes a pair of penetrations 150 located on each side of the circular passageway 146, each for receiving a fastener 152 for securing a top support bearing 154 and a bottom support bearing 156 to the block. The general function of the pair of support bearings 154, 156 is to provide rotational support to the limiter shaft axes of rotation 148.

The range limiter and drive device 120 is comprised of the range limiter disc 102 and a cover plate 158 mounted above the limiter disk. The cover plate 158 includes a center penetration 160 which is in alignment with a center penetration 162 formed within the limiter disk 102. The limiter shaft axis of rotation 148 which is mounted in the support bearings 154, 156 on the block 122, extends upward and passes through each of the center penetrations 160, 162.

Adjacent to the center penetration 160 on the cover plate 158 is a pair of mounting holes 164 for receiving an equivalent number of threaded fasteners 166 for securing the cover plate to an actuator arm bracket 168. Further, the cover plate 158 includes a keyhole 170 for permitting the passage of the range limiter pin 112 which is also mounted on and extends through the actuator arm bracket 168.

The cover plate 158 is separated from the range limiter disk 102 by a spacer 172 which is mounted over the limiter shaft axis of rotation 148. The range limiter disk 102 includes a plurality of selector penetrations 174 which are distributed about the limiter disk in, for example, an orthogonal pattern for permitting the insertion of the range limiter pin 112 through the selected penetration. By varying the particular selector penetration 174 through which the limiter pin 112 is inserted, the range of motion measured in mechanical degrees may be controlled. Therefore, by inserting the limiter pin 112 in the first of the selector penetrations 174, a maximum range of motion may exist for concentric movement of the limb while a minimum range of motion may exist for an eccentric movement. Likewise, by choosing a second selector penetration 174 oppositely positioned from the first selector penetration on the limiter disk 102, a maximum range may exist for the eccentric movement while a minimum range may result from the concentric movement. Yet a third selector penetration position may result in equivalent ranges of motion for each of the above-described movements.

The limiter disk 102 is fixed to and rotates with the limiter shaft axis of rotation 148 as does the cover plate 158. Therefore, in order to readjust the position of the limiter pin 112, an upward force must be applied for removing the limiter pin from the keyhole 170 thereupon the cover plate may be rotated over the surface of the limiter disk. Upon aligning the keyhole with the proper selector penetration 174, the limiter pin 112 may be repositioned into the newly selected penetration. The limiter pin may be spring loaded and may include a mechanical tab to prevent inadvertent removal during movement of the range limiter and drive device 120. The cover plate 158 also provides cosmetic utility by hiding the plurality of selector penetrations 174 formed through the limiter disk 102. Once the limiter pin 112 is positioned in the selector penetration 174, the cover plate rotates with the limiter disk. The limiter disk further includes a counterweight 176 affixed to the bottom circumference of the limiter disk for repositioning the disk after use.

The actuator arm bracket 168 also includes a pair of screw receptacles 178 for receiving the pair of threaded fasteners 166 employed for securing the cover plate to the actuator arm bracket. A spacer piece 180 is mounted between the actuator arm bracket 168 and an actuator arm 182, the arm including a forearm cuff 184 for supporting the forearm of the limb being exercised. Extending beyond the forearm cuff 184 and mounted on an adjustable bracket 186 is the wrist cuff 110. The adjustable bracket 186 includes a plurality of adjustment holes 188 for permitting the adjustable bracket to be extended from or retracted into the actuator arm 182.

Mounted on the actuator arm is a cornerlocking device 190 which is employed for locking the adjustable bracket 186 to the actuator arm 182 for adapting to the length of the limb being exercised. The plurality of adjustable holes 188 may include an interior thread for accepting the threaded shaft of the cornerlocking device 190. This construction eliminates excess movement and free play which commonly exists with a simple selector pin. By combining the adjustable range limiter disk 102 with the adjustable bracket 186, the size of the limb and the prescribed range of motion may be accommodated.

The direct drive shaft 106 is connected directly to the range limiter disk 102 through a linkage rod 192 as is shown in FIG. 5. Each end of the linkage rod 192 is threaded for receiving a rod end 194, each of which includes a tab 196 which has been machined to include spherically shaped surfaces for providing high wear resistance. With this design, the rod ends 194 may be subject to constant operation with minimal wear through the linkage rod 192. The end of the direct drive shaft 106 extending away from the inclined cam surface 104 is connected to a linkage bracket 198. The linkage bracket is a U-shaped bracket having a set screw 200 for passing through the tab 196 of the first of the rod ends 194 for securing the linkage bracket 198 to the linkage rod 192. Such a construction secures the direct drive shaft 106 to the linkage rod 192 via the linkage bracket 198.

The second of the pair of rod ends 194 of the linkage rod 192 also includes one of the tabs 196 for physically connecting to the range limiter and drive device 120. A spacer penetration 202 is formed through the limiter disk 102 at the outer circumference thereof. The tab 196 is secured to the spacer penetration 202 by a threaded fastener 204 and a threaded nut 206.

During the operation of the actuator arm 182 and the range limiter disk 102, the pair of wear resistant rod ends 194 are caused to continuously pivot about the set screw 200 of the linkage bracket 198 and the combination of the threaded fastener 204 and the threaded nut 206 secured to the spacer penetration of the range limiter disk. These two joints in combination with other novel and non-obvious features of the instant invention permit the rotational motion imparted to the range limiter disk to be converted to translational motion of the inclined cam surface 104 via the direct drive shaft 106.

The direct drive shaft 106 is physically connected to the linkage bracket 198 on the foreward end and is bolted to the inclined cam surface 104 by a plurality of bolts 208 on the rearward end of the drive shaft. The direct drive shaft is supported by and passes through a first linear bearing 210. The general function of the first linear bearing 210 is to provide alignment and support of the drive shaft during translational movements. Therefore, as the drive shaft translates through the first linear bearing 210 upon the operation of the range limiter and drive device 120, the inclined cam surface 104 translates along with the direct drive shaft 106. In construction, the first linear bearing 210 is mounted to a first bearing bracket 212 secured to the drive mechanism support beam 118 by a plurality of mechanical fasteners 214.

The dogleg support column 124 is designed to support the weight stack 108 in the following manner. Extending beyond the top of the dogleg support column 124 is a canopy 216 having a penetration 218 formed at one end as is shown in FIGS. 4 and 6. Fastened to the penetration 218 either by a fastener or by threaded means is a cantilever guide pin 220 having a flange 222 mounted on the base thereof. The guide pin 220 penetrates a cantilever arm 224 which includes a cam follower bracket 226 for securing a cam follower 228 thereto by employing a securing pin 230. The cam follower 228 is employed for pulling the weight stack 108 up and down the inclined cam surface 104.

The inclined cam surface 104 is comprised of a predetermined inclined path having a flat surface which may be at an incline angle of, for example, 30 degrees but may be at a different angle depending upon the resistance desired in the application. The surface of the inclined cam may be coated with a high wear resistance metal which has a low coefficient of friction to minimize wear on the cam follower 228 and on the cam follower bracket 226 which secures the cam follower in place.

Extending downward from the cantilever arm 224 is an alignment and support shaft 232 which passes through the weight stack 108. The alignment and support shaft 232 also passes through a second linear bearing 234 mounted on a second bearing bracket 236 secured to the upper support column 114. The alignment and support shaft also passes through a bottom support bracket 238 which extends outward from the upper support column 114.

The weight stack is comprised of individual weights each divided into an incremental weight and each including an alignment hole 240 for permitting the passage of a guide shaft 242 which functions to prevent the individual weights of the weight stack 108 from turning or twisting out of position. This is significant since each weight of the weight stack includes an adjustment slot 244 for receiving a weight selector pin 246 for selecting the weight to be utilized in a therapeutic exercise. Once the weight selector pin 246 is placed in a selected adjustment slot 244, the alignment and support shaft 232 which passes through a center opening 248 of each individual weight and which also receives the selector pin, carries only those weights which are positioned at or above the adjustment slot 244 being occupied by the selector pin 246.

In accordance with the construction of the instant invention, as the actuator arm 182 is caused to rotate by a force being applied to the adjustable wrist cuff 110 and the forearm cuff 184, the range limiter disk 102 is caused to rotate in the direction in which the force is applied and through a range of movement controlled by the range limiter pin 112. As the limiter disk is caused to rotate, the linkage rod 192 will swivel within the linkage bracket 198 converting the rotational motion of the range limiter and drive device 120 to translational motion of the direct drive shaft 106. The drive shaft translates through the first linear bearing 210 pulling the inclined cam surface 104 therewith. As the inclined cam surface moves forward, the cam follower 228 is caused to roll up the inclined cam surface. As the cam follower moves upward, the cantilever arm 224 is forced upward along the cantilever guide pin 220 carrying the alignment and support shaft 232 and the selected weights therewith. At the completion of the first movement, a first group of muscles have been employed for operating the apparatus 100.

Because of the flexibility of the range limiter disk 102, the first movement may employ either an eccentric or a concentric motion. Upon completion of the first movement, a second movement employing a second group of muscles opposing the first group of muscles is initiated. The second movement, being in opposition to the first movement, employs a second muscle group to resist the movement of the cam follower 228 down the inclined cam surface 104. As the cam follower moves down the cam surface, the cantilever arm 224 slides down the cantilever guide pin 220 carrying the alignment and support shaft 232 and the selected weights therewith.

As the actuator arm 182 returns to the starting position of the first movement, the linkage rod 192 repositions itself into linear alignment with the direct drive shaft 106 with the assistance of the counterweight 176. At the end of the second movement, the cam follower is resting at the bottom of the inclined cam surface and the cantilever arm 224 is resting on the flange 222 mounted to the bottom of the cantilever guide pin 220. As the weight stack is moved up and down, the alignment and support shaft 232 passes through the second linear bearing 234 which provides alignment and support.

At the very top of the inclined cam surface 104, a permanent mechanical stop 250 may be positioned for preventing the cam follower 228 from extending beyond the inclined cam surface in a situation in which the range limiter disk 102 is positioned for the maximum range of movement.

An additional feature incorporated into the invention includes a range limiter stop 252 which is incorporated into the drive mechanism support beam 118. The range limiter stop includes a graduated scale 254 located on the drive mechanism support beam which is visible from the position of the actuator arm 182. The graduations on the scale 254 may be in any convenient parameters which may be utilized in therapeutic exercise. Employed in conjunction with the graduate scale is an adjustable stop clamp 256 which may include a threaded adjustment 258 as is shown in FIG. 5.

Prior to the exercise, the adjustable stop clamp 256 may be positioned at the proper location on the graduated scale 254. During the movement of the actuator arm, the range limiter stop 252 may be employed for limiting the range of motion by physically stopping the linkage rod 192. Thus, the range limiter stop may be used in conjunction with the limiter pin 112 of the range limiter disk 102 for further limiting the peak position in the selected range of motion. However, it should be noted that the adjustable stop clamp 256 may be incorporated into the drive mechanism support beam 118 in any feasible method by using a selector pin or cornerlock device. The stop clamp 256 is shown for illustrative purposes only.

It is important to distinguish between the range limiter stop 252 which is employed for limiting the stroke of the linkage rod 192 at the high end of the range of motion from the range limiter disk 102 which controls the starting point of the range of motion by inserting the limiter pin 112 into the proper selector penetration 174 on the limiter disk.

An example will serve to demonstrate the utility of the direct drive rehabilitation and fitness apparatus 100. During therapeutic exercise, the apparatus may be employed for exercising either of the shoulder joints. Recognizing that the axis of rotation passes through the elbow and the shoulder, the arm should be bent at a 90° angle at the elbow and then placed adjacent to the body so that an acute angle of approximately 30° is formed between the arm and the trunk of the body. With the arm in this position, the forearm should be positioned in the forearm cuff while the hand should be positioned in the adjustable wrist cuff 110. The positioning of the acute angle is significant so that the axis of rotation of the shoulder rotater cup is aligned with the limiter shaft axis of rotation 148 as shown in FIG. 5. The position of the arm as described above is generally referred to as the neutral position.

Generally, a concentric movement shortens the muscle fiber while an eccentric movement lengthens the muscle fiber. If the palm of the hand is positioned so that the movement of the hand is towards the body, the movement is described as an internal rotation of the shoulder. However, when the hand is pushed away from the body from the neutral position, the movement is defined as an external rotation of the shoulder. By practicing these movements while the arm is positioned as described in the apparatus 100, the movement resulting in an internal rotation or the concentric contraction of the internal rotator may be accomplished by moving the actuator arm 182 towards the body which forces the cam follower 228 up the inclined cam surface 104 carrying the weight stack 108 therewith.

Once the actuator arm 182 reaches the maximum range of rotation, the concentric muscle contraction retains the weight stack in the air. However, eccentric muscle contractions are required to move the actuator arm back to the neutral position in a controlled manner. Therefore, the palm of the hand as applied against the wrist cuff 110 applies a force against the weight stack resulting in the stretching or the eccentric contraction of the internal rotator of the shoulder being exercised.

One of the many novel and non-obvious features of the instant invention is that the apparatus 100 may be employed to shift from exercising the internal rotators of one shoulder to exercising the external rotators of the same shoulder. Thus, by employing the instant invention, the eccentric and concentric movements of a first muscle group may be performed on the same rehabilitation apparatus as the eccentric and concentric movements of an opposing muscle group simply by adjusting the range limiter pin 112.

Upon repositioning the range limiter pin 112, the exercise begins by placing the same arm in the neutral position with respect to the body. The hand is placed in the adjustable wrist cuff 110 while the limb is placed in the forearm cuff 184 and the movement pattern is from the neutral position away from the body in external rotation of the shoulder. The pattern of movement is more apply described as the arm being rotated outward in external rotation and is actually a concentric contraction of the external rotater. This movement of the actuator arm 182 causes the angle between the limb being exercised and the trunk of the body to increase while the elbow is isolated along the axis of rotation resulting in the weight stack 108 moving upward. In order to maintain the weight stack in the elevated position, resistance must be applied with the shoulder. As the limb being exercised is relaxed and permited to slowly move back towards the trunk of the body, a stretching or eccentric contraction of the external rotator results. This is the case even though the movement of the actuator arm is internal because the movement defining an eccentric external rotation is the movement of the arm from the extended position towards the trunk of the body.

The machine is extremely useful in the areas of physical fitness and rehabilitation. An example is that of a baseball pitcher. Because the movements of the shoulder joint during the execution of pitching a ball result in extensive use of the rotator cup, the rehabilitation and fitness apparatus 100 may be employed for developing and conditioning the muscles and shoulder joint in preparation of the activity. Likewise, the apparatus may be employed for therapeutic exercise during the rehabilitation of the shoulder joint subsequent to corrective surgery.

During delivery of the baseball pitch, the arm and the shoulder joint are both located behind the head of the pitcher while the elbow is in isolation which results in an external rotation position. However, when the arm comes forward of the head during the delivery of the ball, the shoulder is in an internal rotation position. Because the apparatus 100 is designed to emulate these positions, it is extremely useful in the development and conditioning of both an injuried and a healthy shoulder joint. Conditioning of the healthy shoulder joint acts as a preventive measure against a common injury to the rotator cup.

It should further be noted that the combination of elements as described in the preferred embodiment of the apparatus 100 may be conveniently retrofitted to a plurality of exercising devices which are employed for performing eccentric and concentric contractions of opposing muscle groups. Examples of existing devices which are candidates for the retrofitting of the rehabilitation and fitness apparatus 100 include but are not limited to any weight training station associated with a circuit training device or any bench pressing, leg extension or leg pressing device which employs articulated lingkage for raising a stack of weights. By employing the apparatus 100, the existing problems as previously described may be overcome by eliminating belts, cables, chains, pulleys, safety guards and the like.

The following are descriptions of alternative embodiments which incorporate the direct drive linkage between the range limiter and drive device and the weight stack but which are somewhat modified for a variety of applications. A first alternative embodiment of the present invention identified by the general reference number 300 is shown in FIG. 7. In this instance, the first alternative embodiment of the rehabilitation and fitness apparatus 300 in FIG. 7 is also of the direct drive type similar to the rehabilitation and fitness apparatus of FIGS. 1 through 6. Parts of the apparatus of FIG. 7 which find substantial correspondence in structure and function to those parts of FIGS. 1 through 6 are designated with corresponding numerals of the 300 series. The apparatus 300 includes a range limiter disk 302 which is in mechanical communication with a cover plate 358, each including a center penetration 360, 362 respectively for mounting over the limiter shaft axis of rotation 348.

The structural lattice support of the apparatus 300 differs somewhat from that existing in the preferred embodiment 100. An upper support column 314 is employed for supporting a range limiter and drive device 320 while a lower support column 326 acts as a vertical member which is connected to a base 328. The base includes a plurality of diagonal supports 330 which are employed for supporting the vertical structure of the lower support column 326. At the interface between each element of the base 328 and each diagonal support 330 is a mounting plate 332 having a penetration 334 formed therein for mounting to the floor.

A direct drive shaft 306 passes through a weight stack 308 for providing alignment and support in addition to translating the rotary motion imparted to the range limiter and drive device 320 to translational motion of the weight stack. The direct drive shaft passes through a linear bearing 316 which is mounted on a bearing plate 318 secured to the upper support column 314. The drive shaft is in mechanical communication with a linkage bracket 322 having a set screw 324. The set screw 324 is employed for securing one of a pair of tabs 396 of a rod end 394 which is fastened to the end of a linkage rod 392 as by mechanical threads for connecting the weight stack 308 to the range limiter disk.

The opposite end of the linkage rod 392 includes a second of the rod ends 394 including a tab 396 for connecting to a spacer penetration 398 (not shown). Therefore, as the range limiter and drive device 320 is rotated, a direct link exists to the weight stack 308 via the linkage rod 392 and the direct drive shaft 306. The linkage bracket which connects the direct drive shaft to the linkage rod 392 is secured to and rides within a guide slot 336 formed within the upper support column 314.

The construction of the range limiter and drive device 320 is very similar to that described in FIG. 5 of the apparatus 100. The range limiter disk 302 is secured to the limiter shaft axis of rotation 348 while the cover plate 358 is separated from the limiter disk by a spacer 372 (not shown). Further, a plurality of selector penetrations 374 are formed in the range limiter disk 302 for receiving a range limiter pin 312 that is mounted through a keyhole 370 formed within the cover plate 358. Further, the cover plate includes a plurality of mounting holes 364 and threaded fasteners 366 employed for securing the cover plate 358 to an actuator arm 382. The actuator arm is in mechanical communication with the limiter shaft axis of rotation 348 and may be, for example, rectangular in shape for receiving the end of an adjustable bracket 386 having an adjustable wrist cuff 310 attached to the end thereto. The adjustable bracket includes a plurality of adjustment holes 388 which may include a threaded interior for mating with a cornerlocking device 390 extending through the actuator arm 382. The adjustment bracket 386 is employed for adjusting the height of the wrist cuff and the actuator arm to accommodate the height of the limb to be exercised. Additionally, the bottom of the range limiter disk 302 may further include a counterweight 338 for returning the limiter disk to the neutral position at the end of the exercise.

The construction of the weight stack 308 is very similar to that employed in the apparatus 100. The direct drive shaft 306 passes through a center opening 340 in each individual plate of the weight stack. Also included is an alignment hole 342 passing through each individual weight for accommodating a weight stack guide shaft 344 for preventing the twisting or misalignment of the individual weights. Additionally, each of the individual weights include an adjustment slot 345 for receiving a weight selector pin 346 for permitting a specific weight to be selected for a particular therapeutic exercise. The alignment slot 345 passes through each individual plate and through a bore hole in the direct drive shaft 306 for securing the selected weight to the drive shaft. Therefore upon rotation of the actuator arm 382, the adjustment slot 345 of the weight having the selector pin 346 mounted therein will be carried along with the drive shaft. As in the rehabilitation and fitness apparatus 100 of the preferred embodiment, the guide shaft extends well below the bottom of the weight stack for maintaining alignment of the weight stack when the drive shaft is withdrawn from the unselected weights during operation of the apparatus.

During the operation of the apparatus 300, the operator may be seated or standing. By placing the limb of the operator in the adjustable wrist cuff 310, the actuator arm 382 may be rotationally operated in either the clockwise or the counter clockwise direction depending on whether a concentric or eccentric movement is being performed. During the therapeutic exercise of either shoulder joint, the arm is placed in the neutral position as previously described. The palm of the hand is placed against the appropriate side of the wrist cuff and a force is applied to the actuator arm 382.

Upon operating the actuator arm, the range limiter disk 302 rotates through a range of motion which is controlled by the position of the range limiter pin 312. As the limiter disk is rotated, the linkage rod 392 which is connected at the rod ends 394 between the bottom of limiter disk and the linkage bracket 322, acts as a cranking member. The tabs 396 located on the rod ends 394 act as swivel joints for permitting the rotational motion imparted to the range limiter and drive device 320 to be converted to translational motion in the direct drive shaft 306. The drive shaft also acts as the weight stack selector and guide rod as described in the apparatus 100 of the preferred embodiment. As the the translational motion is imparted to the drive shaft, the weight stack 308 moves with the drive shaft. The linkage bracket 322 which acts as a swivel point for the linkage rod 392 is also caused to translate along the guide slot 336 formed in the upper support column 314.

Each of the motions previously described with reference to the preferred embodiment relating to exercise of the shoulder rotator is equally applicable in the first alternative embodiment of the rehabilitation and fitness apparatus 300 as shown in FIG. 7.

A second alternative embodiment of the rehabilitation and fitness apparatus designated by the general reference 400 is shown in FIG. 8. The apparatus 400 is of the direct drive type employing an inclined cam surface in combination with a cam follower somewhat similar to the rehabilitation and fitness apparatus 100 of FIGS. 1 through 6. Parts of the apparatus of FIG. 8 which finds substantial correspondence in structure and function to those parts of FIGS. 1 through 6 are designated with corresponding numerals of the 400 series.

As in the previous designs, the rehabilitation and fitness apparatus 400 includes a range limiter disk 402 which is mounted upon a drive support structure 416 and which is parallel to a cam support structure 418. Each of the drive and cam support structures have a pair of legs 422 which are employed for supporting the apparatus 400. In addition, the cam support structure 418 includes an upper support column 414 mounted on a plateau surface 424 of the cam support structure. Mounted across both the cam and drive support structures is a main frame 426 which is employed for providing horizontal structural support.

Mounted on the main frame of the drive and cam support structures 416, 418, are a first linear bearing 428 and a second linear bearing 430, respectively. The first linear bearing 428 is mounted on the plateau surface 424 of the cam support structure 418 while the second linear bearing 430 is mounted upon the plateau surface of the drive support structure 416. Both the first and second linear bearings are employed for assisting in the translational movements of a direct drive shaft 406. Mounted to that portion of the direct drive shaft 406 which is supported by the first linear bearing 428, is a double inclined cam surface 404 which moves with the drive shaft 406. Likewise, that portion of the direct drive shaft 406 supported by the second linear bearing 430 includes a linear gear rack 436 mounted thereto. The gear rack interfaces with a range limiter and drive device 420 which includes the range limiter disk 402.

Mounted above the range limiter disk 402 and separated therefrom by a spacer 472 (not shown) is a cover plate 458. A limiter shaft axis of rotation 448 passes through both the limiter disk and the cover plate as is illustrated in FIG. 8. Mounted about a portion of the circumference of the range limiter disk 402 is a driving gear 440 which rotates with the limiter disk and meshes with the linear gear rack 436. Therefore, as the limiter disk 402 is rotated about the linear shaft axis of rotation 448, the driving gear 440 which is permanently attached to the limiter disk causes the linear gear rack 436 to translated in a horizontal manner.

The cover plate 458 includes a keyhole 470 which is utlized for providing access to a plurality of selector penetrations 474 (not shown) formed in the limiter disk 402 for the passage of a range limiter pin 412. The range limiter pin is employed for adjusting the starting position of a foot pedal 410 operated by the limb to be exercised.

The foot pedal 410 is connected to a pair of actuator arms 482 which are in turn secured to the range limiter disk 402. The actuator arms comprise a solid connection so that even a small lateral movement of the foot pedal results in a slight rotation of the limiter disk. Located at the base of the foot pedal and approximately center to the width dimension is heel slot 478 for accommodating a heel support 480 as is shown in FIG. 8. The base of the heel support 480 extends through the heel slot and includes a penetration for receiving a heel adjustment rod 486. Extending from the bottom side of the foot pedal is a support eyelet 484 for supporting and aligning the heel adjustment rod 486. Mounted on the end of the heel adjustment rod is an adjustment knob 488 which may be turned for adjusting the position of the heel support 480.

That portion of the heel adjustment rod 486 which extends through the bottom of the heel support is threaded so that by rotating the adjustment knob 488 in the proper direction, the position of the heel support 480 may be adjusted. Also included is a spring guide shaft 490 fastened to the structure in a well known manner and including a spring pin 492 extending from one end of the guide shaft. Connected to the spring pin is one end of a foot pedal counterbalance spring 476, the opposite end of the spring being connected to the bottom of the foot pedal 410 at a spring eyelet 494 for returning the foot pedal to a neutral position upon the termination of a therapeutic exercise.

The drive support structure 416 and the cam support structure 418 each further include a mounting plate 432 attached to the bottom of each of the pair of legs 422. Each mounting plate 432 further includes a penetration 434 for mounting the apparatus 400 to the floor. Further, the direct drive shaft 406 passing through the first linear bearing 428 also passes through a cam guide 442 which is employed for providing guidance and stability to the direct shaft 406 and the double inclined cam surface 404 attached thereto.

Mounted on the surface of the double inclined cam surface 404 is a cam follower 444 which is held in position by a follower bracket 446 attached directly to a selector and guide rod 450. As in the rehabilitation and fitness apparatus 100 of the preferred embodiment, the selector and guide rod 450 passes through a center opening 452 of a weight stack 408. A bearing bracket 454 is mounted to the upper support column 414 for securing a third linear bearing 456 which provides guidance to the selector and guide rod 450 and supports the individual weights of the weight stack 408. As in the previous embodiments, each individual weight may include a weight stack alignment hole 460 for accommodating a weight stack guide shaft 462 which maintains the alignment of the individual weights. Since each weight includes an adjustment slot 464, the continuous alignment provided by the guide shaft 462 permits the adjustment slot 464 for a particular weight to b aligned with a borehole (not shown) formed in the selector and guide rod 450 for receiving a selector pin 466 as shown in FIG. 8.

The rehabilitation and fitness apparatus 400 is specifically designed for the therapeutic rehabilitation of the ankle joint. In particular, the ankle exercises performed on the apparatus 400 would include eversion which is a movement with the foot turned outward and inversion which is a complementary movement with the foot turned inward. Therefore, the operator of the apparatus 400 would normally be positioned in a weight supporting seat (not shown) located above the drive support structure 416. Once the operator was seated, the foot to be exercised would be positioned onto the foot pedal 410. The heel of the foot would be positioned against the heel support 480 while the adjustment knob 488 is rotated in the proper direction for sizing the heel support for the particular foot to be exercised.

The proper weight on the weight stack 408 may be selected by inserting the selector pin 466 into the proper adjustment slot 464. A further adjustment is made by inserting the range limiter pin 412 into the proper selector penetration 474 located within the range limiter disk 402 for determining the range of motion of the eversion and inversion movements.

Upon completion of the preliminary adjustments to the apparatus 400, a lateral force may be applied to the foot pedal 410 by moving the foot pedal from side to side turning the foot outward in an eversion movement and then immediately turning the foot inward in the opposite direction in a inversion movement. During the eversion movement when the foot is turned outward, the range limiter disk 402 is forced to rotate the driving gear 440 which causes the linear gear rack to move in a corresponding direction. The movement of the gear rack results in a translational movement of the direct drive shaft 406 forcing the cam follower 444 and the selector and guide rod 450 upward along one of the dual inclined cam surfaces 404.

Upon releasing the force applied by the foot, the foot pedal is permitted to return to the starting point or the neutral position resulting in an inversion movement of the same ankle joint. This action permits the range limiter disk 402 to return to the beginning or neutral position driving the linear gear rack 436 back to the starting point. This permits the cam follower 444 and the selector and guide rod 450 to return to the starting position by lowering the stack of weights. It should be noted that the direct drive shaft 406 causes the inclined cam surface 404 to translate in a horizontal direction requiring a vertical movement in the cam follower. The selector and guide rod merely moves in an up and down direction through the third linear bearing 456 carrying the selected weights therewith.

Upon completing the initial movement, the range limiter pin 412 may be repositioned so that the range limiter disk 402 is now in the proper location to perform an inversion movement. With the foot mounted on the heel support 480, a force is applied to the foot pedal 410 for completing an inversion movement which forces the foot inward. During this movement, the range limiter disk 402 is caused to rotate in the direction opposite to the direction of rotation during the eversion movement. The driving gear 440 causes the linear gear rack 436 to move in the opposite direction forcing the drive shaft 406 in the opposite direction so that the selector and guide rod 450 travels up the opposing surfaces of the double inclined cam surface 404. Upon gradually releasing the force on the foot pedal, an eversion movement is completed as the foot pedal returns to the neutral position with the assistance of the foot pedal counterbalance spring 476. Once again the range limiter disk, the linear gear rack, and the inclined cam surface are repositioned to the starting point so that the selector and guide rod 450 roll down the inclined surface permitting the selected weights to be lowered.

The apparatus 400 permits the completion of both the eversion and inversion movements of one set of ankle muscles and, correspondingly, the eversion and inversion movements of an opposed second set of ankle muscles by merely readjusting the range limiter pin 412. The apparatus has significant value for use in hospital rehabilitation centers, physical fitness facilities, and athletic training centers.

Figure 9:
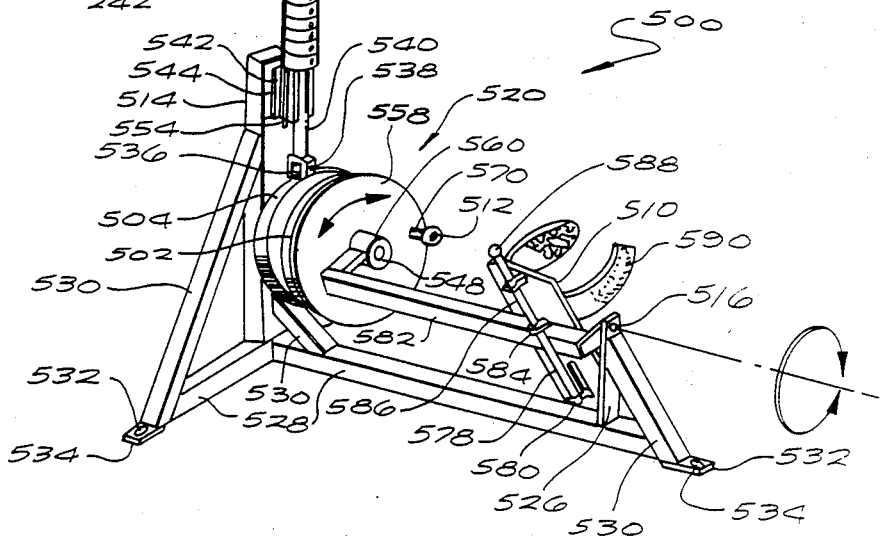
FIG. 9 is a perspective view of a third alternative embodiment of a direct drive rehabilitation and fitness apparatus of the present invention.
Figure 5:
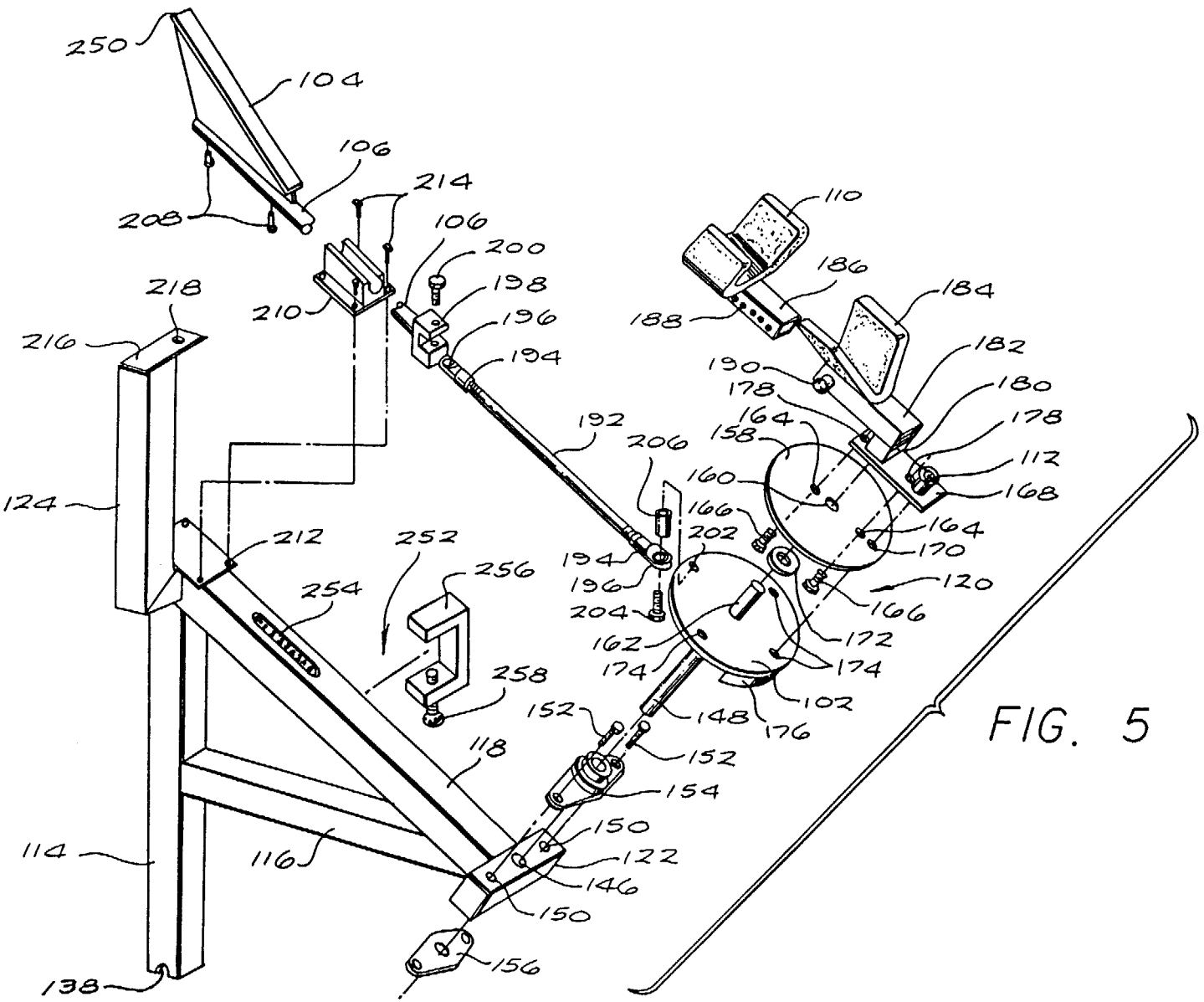

A third alternative embodiment of the present invention identified by the general reference character 500 is shown in FIG. 9. In this instance, the third alternative embodiment of the rehabilitation and fitness apparatus also is of the type employing a cam surface for directly driving a resistance means somewhat similar to the rehabilitation and fitness apparatus 100 of FIGS. 1 through 6. Parts of the rehabilitation apparatus of FIG. 9 which find substantial correspondence in structure and function to those parts of FIGS. 1 through 6 are designated with corresponding numerals of the 500 series.

The rehabilitation and fitness apparatus 500 employs a construction similar to those embodiments previously described in that a range limiter disk 502 is employed for transmitting rotational motion in a range limiter and drive device 520 to translational motion of a weight stack 508 as is described hereinafter. The frame construction of the apparatus 500 includes an upper support column 514 mounted on a base 528 and including a plurality of diagonal supports 530 for securing the upper support column. At the intersection of each base member 528 with the diagonal supports 530 is a mounting plate 532 including a penetration 534 for mounting the base to the floor. Additionally, a lower support bracket 526 mounted vertically above the base 528 and separated but parallel to the upper support column 514 is provided for supporting an actuator arm 582.

The actuator arm 582 extends between the lower support bracket 526 and the range limiter and drive device 520, the actuator arm having the shape of a crank. The point at which the actuator arm 582, the lower support bracket 526 and one of the plurality of diagonal supports 530 join acts as a swivel joint 516 and is located along a limiter shaft axis of rotation 548. It is this swivel joint 516 that permits the actuator arm to rotate when a force is applied thereto. A foot pedal 510 is connected to the actuator arm 582 for applying a force to the range limiter and drive device 520. The foot pedal includes a heel slot 578 for permitting the passage of a heel support 580 for securing the foot to be exercised. Mounted on the bottom of the foot pedal 510 is a pair of support eyelets 584 for securing a heel adjustment rod 586 having an adjustment knob 588 mounted on the end thereof. Further, the foot pedal 510 includes a toe strap 590 comprised of any acceptable securing means such as a buckle strap or a VELCRO strap.

The range limiter and drive device 520 is comprised of the range limiter disk 502 as employed in the previous embodiments and which is separated from a cover plate 558 by a spacer 572 (not shown). Further, the cover plate includes a keyhole 570 for aligning with one of a plurality of selector penetrations 574 (not shown) formed in the limiter disk 502 for permitting the passage of a range limiter pin 512. Utilization of the range limiter pin in the apparatus 500 permits controlling the starting point of the range of motion as in the previous embodiments. The cover plate includes a center penetration 560 for permitting the passage of the limiter shaft axis of rotation 548. Further, the range limiter disk 502 includes a center penetration 562 (not shown) for accommodating the passage of the limiter shaft axis of rotation.

In mechanical communication with the range limiter disk 502 is an eccentric cam surface 504 designed to rotate with the range limiter disk. Riding on the eccentric cam surface 504 is a cam follower 536 mounted within a follower bracket 538. The follower bracket 538 is mechanically connected to a selector and guide rod 540 of which the vertical movements are supported by a first linear bearing 542. The first linear bearing 542 is mounted on a bearing bracket 544 secured to the upper support column 514.

The construction of the weight stack 508 is very similar to the construction of previous embodiments. The weight stack is comprised of individual weights each having a center opening 550 and a weight stack alignment hole 552 for the passage of a weight stack guide shaft 554 for preventing the misalignment of the individual weights. Each of the individual weights include an adjustment slot 556 for receiving a selector pin 564 which is received by the adjustment slot 556 and a borehole formed within the selector and guide rod 540.

The rehabilitation and fitness apparatus 500 is designed for therapeutic exercise of the ankle joint. Specific exercises which may be executed include a dorsiflexion movement in which the ankle joint is exercised by pulling the foot towards the body in alignment with the leg and a plantar flexion movement in which the foot is pushed down and away from the body along the axis of the leg. The operation of the apparatus 500 is as follows. The weight to be employed in the exercise may be selected by inserting the selector pin 564 into the appropriate adjustment slot 556. Then the range limiter pin 512 may be inserted into the proper selector penetration 574 (not shown) located in the range limiter disk 502 for controlling the starting point of the selected range of motion.

The foot to be exercised is then placed on the foot pedal 510 with the heel of the foot being seated on the heel support 580. Simultaneously, the adjustment knob 588 which operates the heel adjustment rod 586 may be rotated in the proper direction for permitting the adjustment rod to be positioned through the support eyelets 584 and to the bottom of the heel support 580. Next, the toe straps 590 may be wrapped about the foot to permit execution of the exercise.

Once in position, the dorsiflexion movement may be executed by applying force for pulling the foot pedal 510 towards the body of the operator. Upon such motion, the actuator arm 582 is caused to operate in one direction resulting in the rotation of the range limiter disk 502. The eccentric cam surface 504 rotates with the range limiter disk causing the cam follower 536 to roll over the eccentric portion of the cam surface. As the cam follower raises on the eccentric cam surface, the selector and guide rod 540 is caused to rise through the first linear bearing 542. Those weights located at or above the weight containing the selector pin 564 will be carried upward with the selector and guide rod 540. Those weights located below the selector pin 564 are supported by the first linear bearing 542.

At the end of the dorsiflexion movement, the foot is forced forward in the plantar flexion movement which opposes that of the dorsiflexion movement. The plantar flexion movement returns the range limiter disk 502 to the initial starting point causing the eccentric cam surface 504 to return to the initial position. This action results in the cam follower 536 rolling across the surface of the eccentric cam lowering the stack of weights to the initial position. After completion of this movement, a first muscle group will have been exercised through a first range of motion.

The range limiter pin 512 may then be readjusted to alter the range of motion of the limiter disk 502 and once again the two movements of dorsiflexion and plantar flexion may be executed. Upon completing each of the movements, the range limiter disk is caused to rotate carrying the eccentric cam surface 504 therewith resulting in the cam follower 536 rolling across the eccentric surface. During the entire cycle, both ranges of motion result in the selector and guide rod 540 being raised and lowered through the first linear bearing 542 and then returned to the initial position. As in the previous embodiments, a first muscle group may be exercised through a range of motion for executing the movements of dorsiflexion and plantar flexion. Subsequently, a second opposing muscle group may be exercised by completing the movements of dorsiflexion and plantar flexion merely by altering the range of motion by adjusting the range limiter pin 512.

An example of an application of the apparatus 500 is the typical ankle injury associated with athletics, particularly track and field events and in football. For an injury to the right ankle, a typical scenario is one in which the operator would be seated behind the machine with the right leg lifted and the knee bent for positioning the right foot on the foot pedal 510. The ankle may be exercised by forcing the foot pedal 510 downward in the plantar flexion movement for flexing the calf muscle. Immediately upon reaching the maximum stroke of the plantar flexion movement, the toes of the right foot may be lifted up for completing the dorsiflexion movement. The downward plantar flexion motion results in contraction of the ankle and calf muscles while the dorsiflexion movement of pulling the foot pedal 510 towards the operator results in a stretching or eccentric movement.

From the foregoing, it will be appreciated that the rehabilitation and fitness apparatus 100 of the present invention permits opposing patterns of movement with the range limiter disk 102 thus making possible both concentric and eccentric movements of opposing muscle groups by simply adjusting the range limiter pin 112, and that connecting the range limiter disk directly to the inclined cam surface 104 through the drive shaft 106 simplifies the design essentially eliminating mechanical play which results in minimal frictional wear. Further, the apparatus 100 is much less expensive to manufacture than similar devices of the past because many components have been eliminated which permits retrofitting the apparatus to existing rehabilitation and fitness devices. Since the apparatus is designed to permit opposing patterns of movements of opposing muscle groups, previously required complementary exercise devices may be eliminated.

While several particular forms of the invention have been illustrated and described, it will also be apparent that various modifications can be made without departing from the spirit and scope of the invention. Accordingly, it is not intended that the invention be limited, except as by the appended claims.

What is claimed is:

1. A rehabilitation and fitness apparatus comprising, in combination:

means for supporting said apparatus;

an actuator arm mounted to said supporting means, said actuator arm being pivoted for providing rotational motion;

means in communication with said actuator arm for limiting the range of rotational motion of said actuator arm;

direct driving means connected to said range limiting means and a surface for converting said rotational motion of said actuator arm to translational motion of said surface; and means for resisting the rotational motion of said actuator arm, said resisting means being vertically movable along said surface in relation to the translational motion of said direct driving means, said actuator arm being rotatably operable through opposing patterns of movement for therapeutically exercising opposing muscle groups by adjusting said range limiting means.

2. A rehabilitation and fitness apparatus comprising, in combination:

means for supporting said apparatus;

an actuator arm mounted to said supporting means, said actuator arm being pivoted for providing rotational motion;

means in communication with said actuator arm for limiting the range of rotational motion of said actuator arm;

direct driving means connected between said range limiting means and an inclined surface for converting said rotational motion of said actuator arm to translational motion of said inclined surface; and means for resisting the rotational motion of said actuator arm, said resisting means being vertically movable along said inclined surface in relation to the translational motion of said direct driving means, said actuator arm being rotatably operable through opposing patterns of movement for therapeutically exercising opposing muscle groups by adjusting said range limiting means.

3. The rehabilitation and fitness apparatus of claim 2 wherein said supporting means comprises an adjustable stand having a broad base.

4. The rehabilitation and fitness apparatus of claim 2 wherein said range limiting means comprises a range limiter disk.

5. The rehabilitation and fitness apparatus of claim 4 wherein said range limiter disk includes a plurality of selector penetrations wherein one of said selector penetrations receives a range limiter pin for limiting said rotational motion of said actuator arm.

6. The rehabilitation and fitness apparatus of claim 2 wherein said direct driving means comprises a linkage rod coupled to a direct drive shaft for accommodating the conversion of rotational motion to translational motion.

7. The rehabilitation and fitness apparatus of claim 2 wherein said resisting means comprises a plurality of adjustable weights mounted on an alignment and support shaft which cooperates with a cam follower for moving said weights along said inclined surface.

8. A rehabilitation and fitness apparatus comprising, in combination:

an adjustable support stand having a broad base;

an actuator arm mounted on said support stand, said actuator arm being pivoted for providing rotational motion;

a range limiter disk mounted between said actuator arm and said support stand for limiting the range of said rotational motion of said actuator arm;

a direct drive shaft connected between an inclined cam surface and a linkage rod extending from said range limiter disk, said direct drive shaft for converting said rotational motion of said actuator arm to translational motion of said inclined cam surface; and a plurality of adjustable weights for resisting the rotational motion of said actuator arm, said plurality of weights being vertically movable along said inclined cam surface in relation to the translational motion of said direct drive shaft, said actuator arm being rotatably operable through opposing patterns of movement for therapeutically exercising opposing muscle groups by adjusting said range limiter disk.

9. The rehabilitation and fitness apparatus of claim 8 wherein said inclined cam surface further includes a wear resistant coating.

10. The rehabilitation and fitness apparatus of claim 8 further including an adjustable wrist cuff in mechanical communication with said actuator arm.

11. The rehabilitation and fitness apparatus of claim 8 wherein said direct drive shaft is mounted within a linear bearing for providing stability and guidance in the translational direction.

12. The rehabilitation and fitness apparatus of claim 8 further including a range limiter stop mounted to said support stand, said range limiter stop limiting the maximum stroke of said direct drive shaft for further restricting the range of motion of said actuator arm.

13. A method for constructing a rehabilitation and fitness apparatus, said method comprising the steps of:

supporting said apparatus by employing a broad based stand;

mounting an actuator arm to said broad based stand, said actuator arm being pivoted for providing rotational motion;

limiting the movement of said actuator arm with a range limiter disk for restricting the range of rotational motion of said actuator arm;

converting the rotational motion of said actuator arm to translational motion of an inclined surface by connecting a direct drive shaft between said range limiter disk and said inclined surface; and resisting the rotational motion of said actuator arm by providing a plurality of adjustable weights, said adjustable weights being vertically movable along said inclined surface in relation to the translational motion of said direct drive shaft, said actuator arm being rotatably operable through opposing patterns of movement for therapeutically exercising opposing muscle groups by adjusting said range limiter disk.

14. A rehabilitation and fitness apparatus comprising, in combination:

means for supporting said apparatus;

an actuator arm mounted to said supporting means, said actuator arm being pivoted for providing rotational motion;

means in communication with said actuator arm for limiting the range of rotational motion of said actuator arm; and direct driving means connected between said range limiting means and a means for resisting the rotational motion of said actuator arm, said direct driving means for converting said rotational motion of said actuator arm to translational motion of said resisting means, said resisting means being vertically movable along said supporting means in relation to the translational motion of said direct driving means, said actuator arm being rotatably operable through opposing patterns of movement for therapeutically exercising opposing muscle groups by adjusting said range limiting means.

15. The rehabilitation and fitness apparatus of claim 14 wherein said supporting means comprises a vertical stand having a broad base.

16. The rehabilitation and fitness apparatus of claim 14 wherein said range limiting means comprises a range limiter disk.

17. The rehabilitation and fitness apparatus of claim 16 wherein said range limiter disk includes a plurality of selector penetrations wherein one of said selector penetrations receives a range limiter pin for limiting said rotational motion of said actuator arm.

18. The rehabilitation and fitness apparatus of claim 14 wherein said direct driving means comprises a linkage rod coupled to a direct drive shaft for accommodating the conversion of said rotational motion to said translational motion.

19. The rehabilitation and fitness apparatus of claim 14 wherein said resisting means comprises a plurality of adjustable weights mounted on a direct drive shaft.

20. The rehabilitation and fitness apparatus of claim 14 further including an adjustable wrist cuff in mechanical communication with said actuator arm.

21. The rehabilitation and fitness apparatus of claim 14 wherein said direct driving means further includes a direct drive shaft mounted within a linear bearing for providing stability and guidance in the translational direction.

22. The rehabilitation and fitness apparatus of claim 14 wherein said supporting means includes a slot for guiding the translational motion of a linkage bracket, said linkage bracket providing a swivel joint within said direct driving means.

23. A method for constructing a rehabilitation and fitness apparatus, said method comprising the steps of:

supporting said apparatus by employing a broad based stand;

mounting an actuator arm to said broad based stand, said actuator arm being pivoted for providing rotational motion;

limiting the movement of said actuator arm with a range limiter disk for restricting the range of rotational motion of said actuator arm; and converting the rotational motion of said actuator arm to translational motion of a plurality of adjustable weights by connecting a direct drive shaft between said range limiter disk and said adjustable weights, said adjustable weights being vertically movable along said broad based stand in relation to the translational motion of said direct drive shaft, said actuator arm being rotatably operable through opposing patterns of movement for therapeutically exercising opposing muscle groups by adjusting said range limiter disk.

24. A rehabilitation and fitness apparatus comprising, in combination:

means for supporting said apparatus;

pedaling means mounted on said supporting means, said pedaling means being pivoted for providing rotational motion;

means in communication with said pedaling means for limiting the range of said rotational motion of said pedaling means;

direct driving means connected between said range limiting means and a pair of inclined surfaces for converting said rotational motion of said pedaling means to translational motion of said inclined surfaces; and means for resisting the rotational motion of said pedaling means, said resisting means being vertically movable along one of said pair of inclined surfaces in relation to the translational motion of said direct driving means, said pedaling means being rotatably operable through opposing patterns of movement for therapeutically exercising opposing muscle groups by adjusting said range limiting means.

25. The rehabilitation and fitness apparatus of claim 24 further including a driving gear mounted on said range limiting means for engaging and driving a gear rack mounted on said direct driving means for providing said translational movement to said inclined surfaces.

26. A method for constructing a rehabilitation and fitness apparatus, said method comprising the steps of:

supporting said apparatus by employing a broad based stand;

mounting a foot pedal to said broad based stand, said foot pedal being pivoted for providing rotational motion;

limiting the movement of said foot pedal with a range limiter disk for restricting the range of rotational motion of said foot pedal;

converting the rotational motion of said foot pedal to translational motion of a pair of inclined surfaces by connecting a direct drive shaft between said range limiter disk and said inclined surfaces; and resisting the rotational motion of said foot pedal by providing a plurality of adjustable weights, said adjustable weights being vertically movable along one of said inclined surfaces in relation to the translational motion of said direct drive shaft, said foot pedal being rotatably operable through opposing patterns of movement for therapeutically exercising opposing muscle groups by adjusting said range limiter disk.

27. A rehabilitation and fitness apparatus comprising, in combination:

means for supporting said apparatus;

pedaling means mounted on said supporting means, said pedaling means being pivoted for providing rotational motion;

means in communication with said pedaling means for limiting the range of said rotational motion of said pedaling means;

an eccentric cam surface mounted to and rotating with said range limiting means for providing an oscillating motion; and means for resisting the rotational motion of said pedaling means, said resisting means having a support shaft for riding on said eccentric cam surface with said support shaft vertically oscillating with said eccentric cam surface for converting said rotational motion of said pedaling means to translational motion of said resisting means, said pedaling means being rotatably operable through opposing patterns of movement for therapeutically exercising opposing muscle groups by adjusting said range limiting means.

28. The rehabilitation and fitness apparatus of claim 27 wherein said support shaft further includes a cam follower for riding on said eccentric cam surface.

29. A method for constructing a rehabilitation and fitness apparatus, said method comprising the steps of:

supporting said apparatus by employing a broad based stand;

mounting a foot pedal to said broad based stand, said foot pedal being pivoted for providing rotational motion;

limiting the movement of said foot pedal with a range limiter disk for restricting the range of rotational motion of said foot pedal;

providing an eccentric cam surface mounted to and rotating with said range limiter disk for providing an oscillating motion; and resisting the rotational motion of said foot pedal by providing a plurality of adjustable weights, said adjustable weights being mounted about a support shaft for riding on said eccentric cam surface with said support shaft vertically oscillating with said eccentric cam surface for converting said rotational motion of said foot pedal to translational motion of said support shaft, said foot pedal rotatably operable through opposing patterns of movement for therapeutically exercising opposing muscle groups by adjusting said range limiter disk.

* * * * *

UNITED STATES PATENT AND TRADEMARK OFFICE

CERTIFICATE OF CORRECTION

PATENT NO. : 4,878,663

DATED : November 7, 1989

INVENTOR(S) : Michael M. Luquette

It is certified that error appears in the above-identified patent and that said Letters Patent is hereby corrected as shown below:

Col. 3, line 67, delete "torqu" and substitute therefor -- torque --;
Col. 17, line 21, delete "b" and substitute therefor -- be --; and
Sheet 3 of 5, Fig. 5, add identification numeral -- 138 -- to the hemispheric indentation located at the bottom of the upper support column 114, as shown on the attached page.

Signed and Sealed this

Twenty-fifth Day of December, 1990

*Attest:*

HARRY F. MANBECK, JR.

*Attesting Officer*

*Commissioner of Patents and Trademarks*